United States Patent [19]

Crisci

[11] 4,079,857

[45] Mar. 21, 1978

[54] CONTAINERS AND CLOSURES

[75] Inventor: Victor Eugene Crisci, Wellsburg, W. Va.

[73] Assignee: Polysar Resins, Inc., Leominster, Mass.

[21] Appl. No.: 772,314

[22] Filed: Feb. 25, 1977

[51] Int. Cl.[2] ..... B65D 41/16

[52] U.S. Cl. ..... 220/306

[58] Field of Search ..... 220/306, 308, 355, 356; 150/.5; 215/317

[56] References Cited

U.S. PATENT DOCUMENTS

| | | | |
|---|---|---|---|
| 3,753,511 | 8/1973 | Ruch | 220/306 X |
| 3,811,597 | 5/1974 | Frankenberg et al. | 220/306 X |

*Primary Examiner*—George T. Hall

*Attorney, Agent, or Firm*—Stevens, Davis, Miller & Mosher

[57] ABSTRACT

A container and closure in which the closure has an inverted U-shaped rim and a cover portion lying within the rim and joined to the inner wall of the closure rim at a position downwards from the base of the 'U'. The shape and size of the container rim is such that when the closure is assembled to it, the inner wall of the closure rim is resiliently flexed inwardly about its junction with the cover portion which is thereby resiliently flexed downwards. The inner wall thus is flexed and twisted to seal against the inner surface of the container rim and applies a positive pressure to assist in sealing. In preferred constructions, the inner wall has an extension below the cover portion. The extension flexes outwards during flexing of the cover portion so as to increase the seal.

3 Claims, 4 Drawing Figures

CONTAINERS AND CLOSURES

This invention relates to containers and closures and essentially is concerned with containers and closures in which the closures have U-shaped rims and a fluid-tight seal is provided between the container inner surfaces and inner walls of the closure rims.

Closure constructions are well know in which U-shaped rims are provided. Normally, a fluid-tight seal is formed between a closure and container rim by having a closure inner wall slightly oversize in diameter to the inner diameter of the container rim so that a force fit results between them. A construction of this kind is described in U.S. Pat. No. 3,321,104. A similar construction but, in addition, incorporating a locking ring in the closure outer wall for engagement with an annular recess in the container wall is described in U.S. Pat. No. 3,223,278.

In none of the container and closure constructions having a fluid-tight seal between inner walls of the closure rims and the container rims, and of which Applicant is aware, has it been possible for the sealing pressure to be increased automatically when filled and closed containers are stored as by stacking them one on another. It is contended that where filled containers are likely to be stored, either for short or long periods, it may sometimes be an advantage to ensure that the fluid-tightness of any seal is positively increased to minimize the possibility of spillage or contamination of the contents.

The present invention concerns a container and closure combination in which the closure has a cover portion surrounded by an inverted U-shaped rim, the rim having radially spaced inner and outer axially extending walls and a base and the cover portion having a junction region with the inner wall at a position spaced along the wall from the base. In the inventive concept, the inner wall is resiliently deflectable in a radially inwards direction above the junction region and this causes resultant twisting of the junction region and downwards resilient deflection of the cover portion. This feature of construction is coupled with the fact that the inner wall has a sealing surface region between the base of the 'U' and the junction region for sealing contact with a sealing surface region of the container. The sealing surface regions are disposed at relative angles and diameters in their unstressed conditions so that when the container rim is placed between the walls, and is urged towards the base of the 'U', a wedge action created between the surface regions at a position towards the base applies a compressive force to the sealing surface region of the closure to effect a radially inwards deflection of the inner wall and downwards deflection of the cover portion to effect and positively assist a fluid-tight seal between the sealing surface regions. With this construction, when the container and closure are assembled together, locking means of the two components coact to urge the container rim towards the base and cause the sealing surface regions to come into mutual sealing contact and apply the compressive force.

In the above construction, the resilient deflection of the cover helps the inner wall to resist deformation and ensures an overall sealing contact of the sealing surface regions from the base and down to the junction region of the 'U' rim.

Any increase in load in a radial inwards direction upon the inner wall of the rim of the closure increases the closing effect of the sealing surface regions together. It follows that when containers in filled and closed condition are stacked together, the closure of each assembly which carries the weight of the container or containers above it is forced more directly onto its container rim. This increases the load upon the inner wall of the closure to increase the sealing effect thereby reducing the possibility of air contamination of contents of the container during storage.

Because of the fact that an increase in load tends to increase the sealing effect between the sealing surface regions, it is preferred to provide a space between the container rim and the base of the U-shaped rim of the closure when the closure is in its normal unloaded condition assembled onto the container. In such an assembly when another filled container is stacked on top, the closure is forced more firmly downwards onto the container rim thus increasing the deflection of the cover portion and providing a positive increase in sealing pressure from the base to the junction region of the inner wall.

It is also of advantage for the inner wall to extend downwardly beyond the junction region as the inward deflection of the inner wall and resultant deflection of the cover portion causes the extension to the inner wall to flex outwardly into sealing engagement with the container. This action thus increases the effective depth of sealing engagement between closure and container.

To assist in the radially inward deflection or twisting effect upon the inner wall, it is to advantage for the outer wall of the closure rim to have an inner diameter in its normal unstrained condition which is less than the outer diameter of the container rim at a position above the locking means and for the outer wall to be substantially inextensible at and below the locking means. In this situation, when the rim is located between the walls of the closure, there is a tendency for the outer wall of the closure rim to impose a radially inward force upon the container rim when the components are assembled to cause the sealing surface region of the container to apply a compressive load upon the sealing surface region of the closure.

One embodiment of the invention will now be described by way of example, with reference to the accompanying drawings in which.

Figure 1:
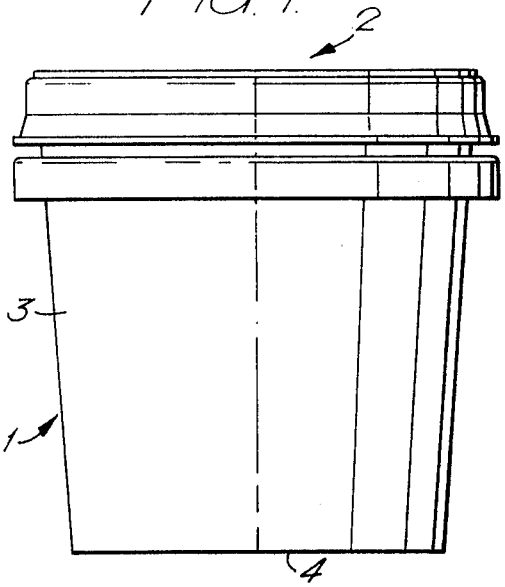
FIG. 1 is a side elevational view of the container and closure assembly according to the invention.

As shown in FIG. 1, a container and closure assembly comprises a container shown generally by numeral 1 and a closure shown generally by numeral 2. The container and closure are each formed by a one piece moulding in plastics material which in this case is high density polyethylene but could be high impact polystyrene or some other resilient flexible material.

Figure 2:
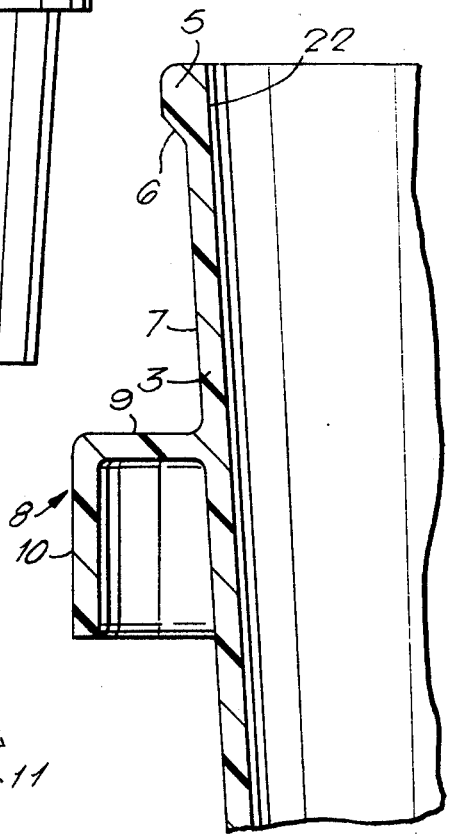
FIG. 2 is a cross-sectional view along the axis of part of the container on a larger scale than FIG. 1.

As can be seen from FIG. 1, the container has a frusto-conical wall 3 commencing at the bottom in a base 4 and diverging to terminate at its top in a rim 5 (see FIG. 2). As can be seen from FIG. 2, the rim 5 is of thicker section than the rest of the side wall. The rim projects outwardly from the side wall and terminates at its lower regions in a sloping abutment surface 6 which extends downwardly and inwardly to the main side wall outer surface 7. Slightly beneath the rim 5 and surface 6 is a reinforcing buttress 8 which extends around and projects from the side wall 3 in annular fashion. The buttress comprises a radially outwardly extending flange 9 terminating in an axially extending flange 10.

Figure 3:
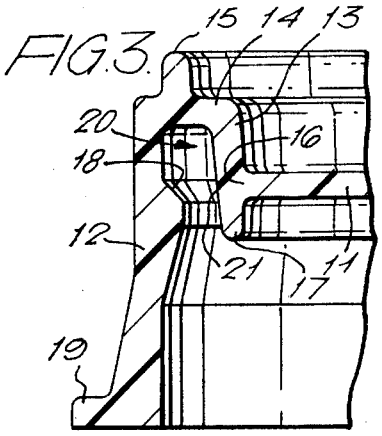
FIG. 3 is a cross-sectional view along the axis of part of the closure and on a larger scale than FIG. 1.

The closure comprises a resiliently flexible cover portion 11 which is capable of being flexed from a normal planar shape as shown in FIG. 3 to a dished shape with its top surface slightly concave as will be described. The cover portion is surrounded by a U-shaped rim comprising radially spaced inner and outer axially extending walls 12 and 13. A base 14 of the U-shape extends between and joins the walls at the top and the base is surmounted by an upwardly extending annular flange 15 which is provided for its positive location within the outer wall of a similarly shaped closure for stacking purposes. The inner wall and the cover portion have a junction region 16 at which point they merge one into the other; and extension 17 of the inner wall extends downwardly beyond the junction region. The inner wall of the closure is resiliently flexible in a radially inwards direction so as to shape itself to the shape of the container rim when closure and container are assembled together as will be described.

The outer wall has a shoulder 18 at a position spaced from the base 14, the shoulder 18 and the surface 6 of the container rim providing locking means which coact as will be described for holding the container rim in a position between the walls of the closure. The outer wall continues downwardly beyond the shoulder 18 and also beyond the extension 17 of the inner wall and is of stiffer and thicker construction at and below the shoulder than above it so as to be substantially inextensible. The stiffness of the lower part of the outer wall is assisted by the use of a radially outwardly extending foot 19.

A space 20 provided between the two walls above the shoulder 18 is of similar shape and cross-section to that of the rim 5 of the container. The space is defined on one side by the outer surface or sealing surface region 21 of the inner wall which extends at an angle to the axis of the rim which is slightly greater than the angle at which the upper inner surface or sealing surface region 22 of the container rim extends to the container axis. The relative angles of the surface regions 21 and 22 are such that in a position adjacent the base 14, the distance across space 20 is slightly less than the thickness of the container rim 5. Also, the inner surface diameter of the outer wall 12 above the shoulder 18 is slightly less than the outside diameter of the rim 5. The sealing surface region 21 of the inner wall is considered to extend downwardly from the base 14 beyond the junction region and includes the outer surface of the extension 17. The sealing surface region 22 of the rim extends downwardly from the top edge of the rim at a distance corresponding to the depth of the sealing surface region 21.

Figure 4:
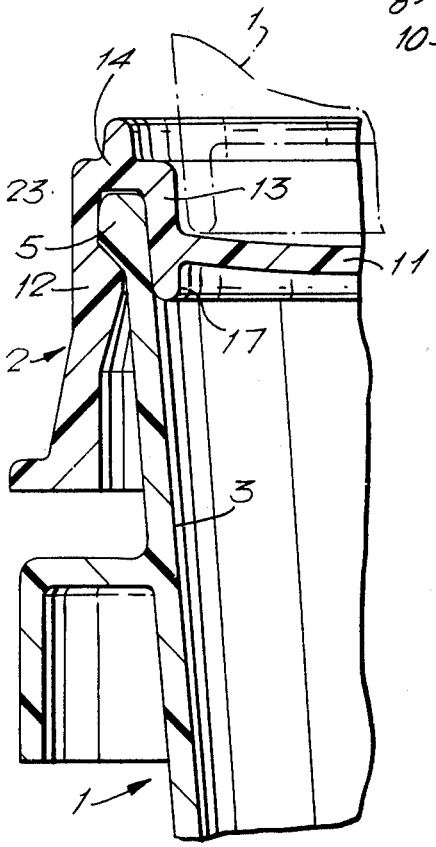
FIG. 4 is a cross-sectional view along the axis of parts of the container and closure assembled together.

During assembly of closure and container together, the container rim initially engages the inside surface of the outer wall 12 thus forcing it radially outwards to enable the container rim to pass beyond the shoulder 18 and into the space 20 between the two walls. As the lower part of the outer wall and the foot 19 of the closure are substantially inextensible, it is only possible to assemble the closure onto the container rim by disposing the rim 5 at one circumferential position within the gap 20 by local distortion of the outer wall and then progressively urging the closure onto the rim 5 around the circumference thereof by a progressive distortion of the outer wall around its circumference to urge the shoulder 18 around the rim 5 until the closure snaps into its final closed position as shown in FIG. 4. In this position, the shoulder 18 coacts with the surface 6 to urge the closure firmly onto rim 5 so that the base of the 'U' rim approaches towards rim 5. During this operation, as the outside diameter of the rim 5 is slightly greater than the inside diameter of the outer wall 12 above the shoulder 18, it necessarily follows that some distortion of both rims must take place to enable the rim 5 to be accommodated within the space 20. As the lower part of the outer wall 12 and foot 19 of the closure is substantially inextensible, such distortion can only take place by virtue of a slight movement outwards of the upper part of the outer wall and also by a slight radially inward movement of the rim 5 itself. This slight radially inward movement together with the fact that the inside diameter of the sealing surface portion 22 of the container is slightly less than the normal diameter of the sealing surface region 21 adjacent to the base 14, causes the inner wall 13 to flex radially inwards in the base area by a pivoting action which takes place around the junction region 16. This pivoting action is accompanied by a resilient downwards deflection of the closure portion 11 as shown in FIG. 4.

The net effect of this is to shape the inner wall 13 substantially into the shape of and to the angle of the sealing surface region of the container so that the two lie lie in mutual engagement along their length and around the whole circumference of the assembly. As the inner wall 13 is resiliently flexed in the radial inwards direction, there is a resilient force acting upon the rim 5 to hold the sealing surface regions in mutual compression so as to provide a fluid-tight seal. The compression is assisted by the resilient flexing of the closure portion 11 which flexes the inner wall 13 radially outwards at the junction region. Also, the extension 17 of the inner wall is flexed in a radially outwards direction so that the extension seats fluid-tightly against the sealing surface region of the container.

As can be seen from FIG. 4, when the closure and container are in their normal assembled condition, i.e. when there is no additional load applied to the top of the container and closure assembly, then there is a small gap 23, which may be up to 0.005 or 0.010 inches, formed between the top of the container rim 5 and the base 14 of the U-shape. Should a filled container and closure assembly be stacked while being stored with other containers on top of it, then the base of the next adjacent container above it may either rest upon the base 14 of the closure or lie within the U-shaped rim and be seated upon the closure portion 11. Such a position for a container 1 is shown by the dotted chain outline in FIG. 4. When containers are stacked in this way, then the load applied by containers on top of a closure tends to urge the closure downwards further onto its associated container thus causing the rim 5 to approach more closely towards the base 14 and close the gap between them until the rim and the base may eventually contact. This movement causes the rim 5 to place a greater load upon the inner wall 13 thus positively increasing the sealing pressure between the sealing surface regions. Further distortion of the inner wall 13 in the radially inwards direction results, and has the effect of causing further downwards distortion of the closure portion 11 which assists in increasing the sealing pressure. In addition to this, an increase in load to add to the sealing pressure is caused by the container carried above the closure being seated upon the cover portion 11 in a position adjacent to the inner wall 13 as shown in FIG. 4.

What is claimed is:

1. A container and closure combination, the container having:

(a) a base;

(b) a side wall extending upwardly from the base and having a rim defining an opening of the container, an inner surface and a sealing surface region of the inner surface extending downwardly from the rim;

(c) and the closure having a resiliently flexible cover portion surrounded by an inverted U-shaped rim;

(d) the rim having radially spaced inner and outer axially extending walls and a base and the rim and cover portion joining at a junction region which is spaced downwardly along the inner wall from the base;

(e) the inner wall being resiliently deflectable radially inwards above the junction region to cause resultant twisting of the junction region and downwards resilient deflection of the cover portion;

(f) the inner wall having a sealing surface region between the base and the junction region for sealing contact by the sealing surface region of the container;

(g) the container and closure having locking means which coact to hold container and closure together and urge the container rim towards the base of the 'U' when the container rim is located between the inner and outer walls of the closure;

(g) the sealing surface regions being disposed at relative angles and diameters in their normal unstressed conditions so that when the container rim is placed between the walls and urged towards the base by the locking means, a wedge action is created between the surface regions at a position towards the base of the U-shape to apply compressive force to the sealing surface region of the closure and effect radially inwards deflection of the inner wall and resultant resilient downwards flexing of the cover portion to effect a fluid-tight seal between the sealing surface regions downwardly along the inner wall.

2. A combination according to claim 1 wherein the outer wall in its normal unstrained condition is substantially inextensible below the locking means of the closure and the outer diameter of the rim of the container is greater than the diameter of the inner surface of the outer wall of the closure at a position above the locking means, the substantially inextensible part of the outer wall imposing a radially inward force upon the container rim, when container and closure are assembled, to cause the sealing surface region of the container to apply a compressive load upon the sealing surface region of the closure.

3. A combination according to claim 1 wherein the inner wall of the closure has an extension downwardly below the cover portion, said extension being resiliently flexible radially outwards by said downwards flexing of the cover portion to fluid-tightly seal against the sealing surface region of the container.

* * * * *